US005667379A

United States Patent [19]

Sporer

[11] Patent Number: 5,667,379

[45] Date of Patent: Sep. 16, 1997

[54] CHARGING RACK FOR FIRING OBJECTS COMPOSED OF CERAMIC OF GLASS CERAMIC MATERIALS

[75] Inventor: Dieter Sporer, Tannheim, Austria

[73] Assignee: Schwarzkopf Technologies Corporation, New York, N.Y.

[21] Appl. No.: 464,719

[22] PCT Filed: Oct. 25, 1994

[86] PCT No.: PCT/EP94/03505

§ 371 Date: Oct. 13, 1995

§ 102(e) Date: Oct. 13, 1995

[87] PCT Pub. No.: WO95/12796

PCT Pub. Date: May 11, 1995

[30] Foreign Application Priority Data

Oct. 30, 1993 [DE] Germany ..... 43 37 189.2

[51] Int. Cl.[6] ..... F27D 5/00

[52] U.S. Cl. ..... 432/258; 432/241

[58] Field of Search ..... 432/258, 259, 432/241

[56] References Cited

U.S. PATENT DOCUMENTS

| | | | |
|---|---|---|---|
| 1,969,126 | 8/1934 | Forse | 432/258 |
| 2,434,852 | 1/1948 | Jackson | 263/47 |
| 3,992,139 | 11/1976 | Lovatt | 432/258 |
| 5,154,984 | 10/1992 | Morita et al. | 428/614 |

FOREIGN PATENT DOCUMENTS

| | | | |
|---|---|---|---|
| 221406 | 5/1962 | Austria | 432/258 |
| 0441574 | 8/1991 | European Pat. Off. . | |
| 2184946 | 12/1973 | France . | |
| 67216 | 7/1969 | Germany . | |
| 2026599 | 2/1971 | Germany . | |
| 3301421 | 7/1984 | Germany | 432/258 |
| 2707953 | 12/1986 | Germany . | |
| 53-043023 | 4/1978 | Japan . | |
| 1240204 | 7/1971 | United Kingdom . | |
| 2164734 | 3/1986 | United Kingdom . | |

*Primary Examiner*—Noah P. Kamen
*Attorney, Agent, or Firm*—Morgan & Finnegan, L.L.P.

[57] ABSTRACT

The invention pertains to a charging rack for firing objects composed of ceramic or glass ceramic materials in kiln, in particular a continuous kiln. The charging rack takes the form of a grate and comprises a frame and a number of bearing parts. The frame is made from a dispersion-hardened iron- or nickel-based alloy and bearing parts are made of the same dispersion-strengthened iron- or nickel-based alloy or from silicon carbide, an oxide ceramic material, a superalloy or a steel.

8 Claims, 2 Drawing Sheets

Fig. 2a
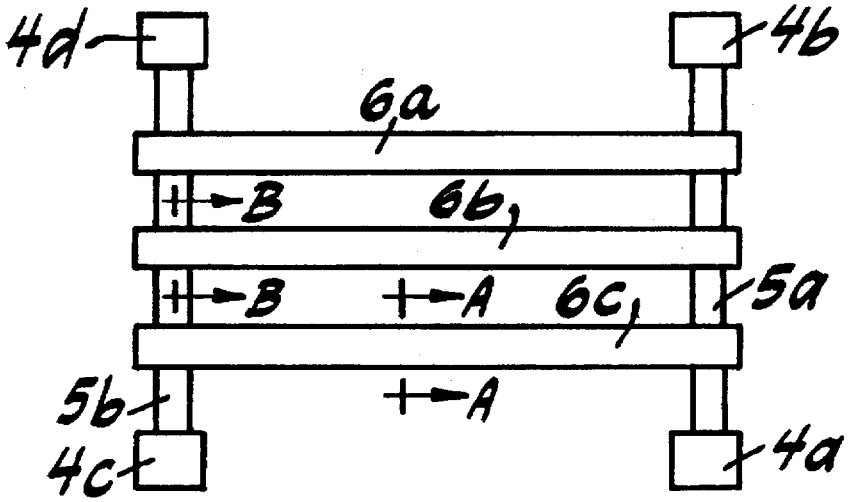
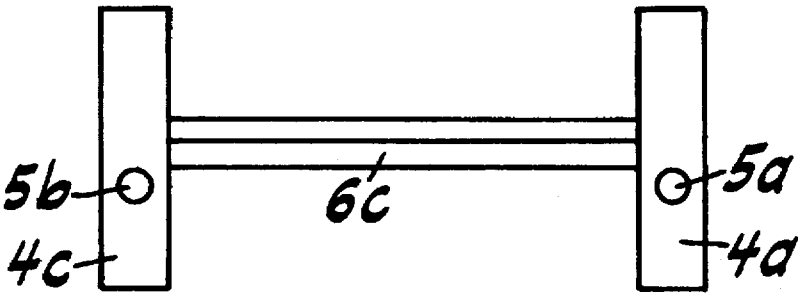
Fig. 2b
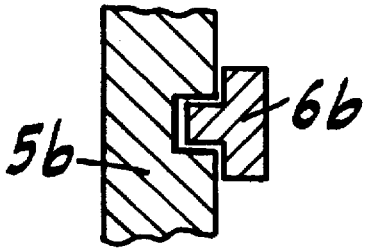
Fig. 2d
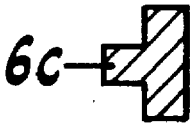
Fig. 2c

CHARGING RACK FOR FIRING OBJECTS COMPOSED OF CERAMIC OF GLASS CERAMIC MATERIALS

BACKGROUND OF THE INVENTION

The invention relates to a charging rack for receiving shaped bodies made of ceramic and glass-ceramic materials, which are baked in a furnace, particularly in a roller-type furnace, whereby the charging rack has the shape of a grid and consists of a frame assembled from a plurality of parts, as well as a plurality of supporting parts, and whereby the parts of the charging rack are manufactured from refractory materials.

Ceramic materials comprise raw materials containing clay minerals and are processed to ceramic articles (e.g. crockery; sanitary ceramics; construction ceramics) by shaping at room temperature and subsequent baking. Glass-ceramic materials comprise glasses which, following shaping and a subsequent heat treatment, are processed to glass-ceramic articles. Partly controlled devitrification occurs in the course of the thermal treatment due to partial crystallization. The baking or heat treatment of ceramic and glass-ceramic materials is carried out at temperatures of 800° to 2000° C., preferably at 1000° to 1400° C., in furnaces which are operated both in batch and continuous operations. The articles shaped from ceramic or glass-ceramic materials are, in many cases, arranged on charging racks, which are then loaded in the furnace, and removed from the latter after the baking process has been completed. Such charging racks have been successfully used especially in continuous furnace operations, which are preferably carried out in roller-type furnaces, because such racks protect the shaped bodies against damage as the latter are being passed through the furnace, and facilitate the handling of the shaped articles.

Known charging racks preferably comprise ceramic materials such as, for example cordierite or mullite, and have the shape of boards. Such charging racks have to be heated and cooled gradually because of their low thermoshock stability. The continuous operation of the baking process is prolonged in a disadvantageous way due to said material property. The known charging racks, which are manufactured from conventional metals, have a low resistance to corrosion and low high-temperature stability, which has an adverse effect on their useful life. Furthermore, owing to their low high-temperature stability, the charging racks made of conventional metallic materials are required to have a high structural weight, which negatively affects the energy household of the baking furnace.

SUMMARY OF THE INVENTION

An object of the invention is to overcome the problem of creating a charging rack that has a low structural weight and a long useful life; which is resistant to corrosion, and which can be heated and cooled rapidly in the course of the baking process.

The problem forming the basis of the invention is solved in that the parts of the frame of the charging rack are manufactured from a dispersion-hardened iron or nickel-based alloy, and the supporting parts of the charging rack are made of the same dispersion-hardened iron- or nickel-based alloy, or from silicon carbide, an oxide-ceramic material, a superalloy, or from steel.

The individual supporting parts of the charging rack, which is shaped in the form of a grid, have surfaces suitable for receiving the shaped articles to be baked. The forces originating from the mass of the individual supporting parts and from the mass of the shaped bodies arranged on the supporting parts are introduced into the frame of the charging rack, the latter consisting of a material having very high thermal stability and, therefore, a relatively low inherent weight. The individual supporting parts have a low inherent weight also because they are required to support only a small number of shaped bodies. Since the structural size of the supporting parts is limited, such parts can be manufactured also from silicon carbide, an oxide-ceramic material (material produced from oxides with the exception of $SiO_2$, and from oxide compounds, using ceramic methods), from a superalloy, or from steel, whereby steel should be used only with low baking temperatures (e.g. 1000° C.). The charging rack, which wholly or partly comprises a dispersion-hardened iron-based alloy, is preferably used with baking temperatures in the range of 1000° to 1400° C. The Charging rack wholly or partly comprises a dispersion-hardened nickel-based alloy, is preferably used with baking temperatures in the range of 1000° to 1100° C. The charging rack according to the invention, which is shaped in the form of a grid, may be designed with a length and width of up to 3 meters, preferably 1.5 meters. Even charging racks of such a size have an unusually long useful life and permit rapid heating and cooling, so they are preferably used in rapid-baking operations. Their structural weight is low, as compared to known charging racks. Furthermore, the charging racks according to the invention have high dimensional stability, which has to be attributed especially to the very low coefficients of thermal expansion of the materials used for the manufacture of the charging racks, as well as to their design in the form of a grid. Finally, the charging racks exhibit good corrosion properties.

According to the invention, it is particularly advantageous if the dispersion-hardened iron-based alloy contains 10 to 40% Cr, 2 to 10% Al, 0 to 5% Ti, 0 to 10% Mo, 0 to 5% W, 0.1 to 2% $Al_2O_3$, $ZrO_2$, $La_2O_3$ and/or $Y_2O_3$, the balance Fe; if the dispersion-hardened nickel-based alloy contains 10 to 40% Cr, 0.1 to 4% Al, 0 to 10% Mo, 0 to 5% W, 0 to 5% Ti, 0.1 to 2% $Al_2O_3$, $ZrO_2$, $La_2O_3$, and/or $Y_2O_3$, as well as the balance Ni; and if the iron- and the nickel-based alloys are produced in the powder-metallurgical way, i.e., by mixing and compressing (pressing, sintering) powders, on the one hand, or on the other hand by mechanical alloying of powders, hot compressing and reshaping of the alloy, with the use of $H_2$ as the protective gas in the processing of the powders. Said alloys have both high thermal stability and high thermoshock stability. The percentages specified above are percents by weight. Dispersion-hardening is effected by the oxide phase (dispersiod) incorporated in the lattice of the alloy, such oxide phase consisting of $Al_2O_3$, $ZrO_2$, $La_2O_3$ and/or $Y_2O_3$.

Surprisingly, it has been found that the dispersion-hardened iron- and nickel-based alloys to be used according to the invention are readily weldable. Therefore, provision has been made according to the invention that the parts of the charging rack consisting of such dispersion-hardened alloys are joined with each other by welding. Welding is carried out according to the TIG-method (nonflash welding with a tungsten electrode in an inert gas), or according to the "MIG/MAG"-method (flash welding with electrodes in an inert gas, e.g. argon or an active gas, for example an $N_2$—$O_2$ mixture). Both welding methods are known per se.

According to the invention, it has been found that it is particularly advantageous if the supporting parts, the latter consisting of silicon carbide, an oxide-ceramic material, a superalloy, or steel, are joined with the frame by mechanical connection means, particularly by means that are detachable (e.g. rivets, screws, plug connections). The use of mechanical connection means permits combining dispersion-hardened alloys with other materials and substantially prolongs the useful life of the charging rack. Rivets are used only for joining metallic parts with each other, and detachable mechanical connection means are used for joining metal parts with the parts consisting of other materials.

BRIEF DESCRIPTION OF THE DRAWINGS

The subject matter of the invention is explained in greater detail in the following by reference to the drawing, in which:

FIG. Ia shows a lateral view of a charging rack whose frame and supporting parts comprise a dispersion-hardened iron-based alloy;

Figure 1A:
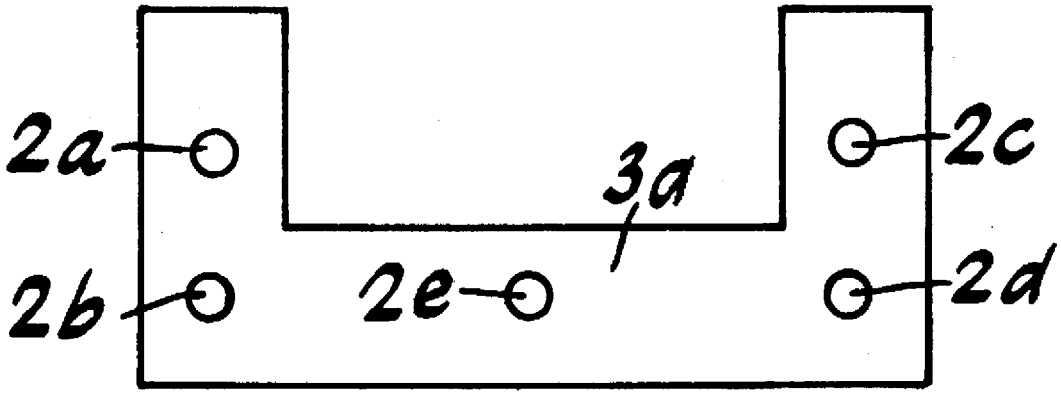
Figure 1B:
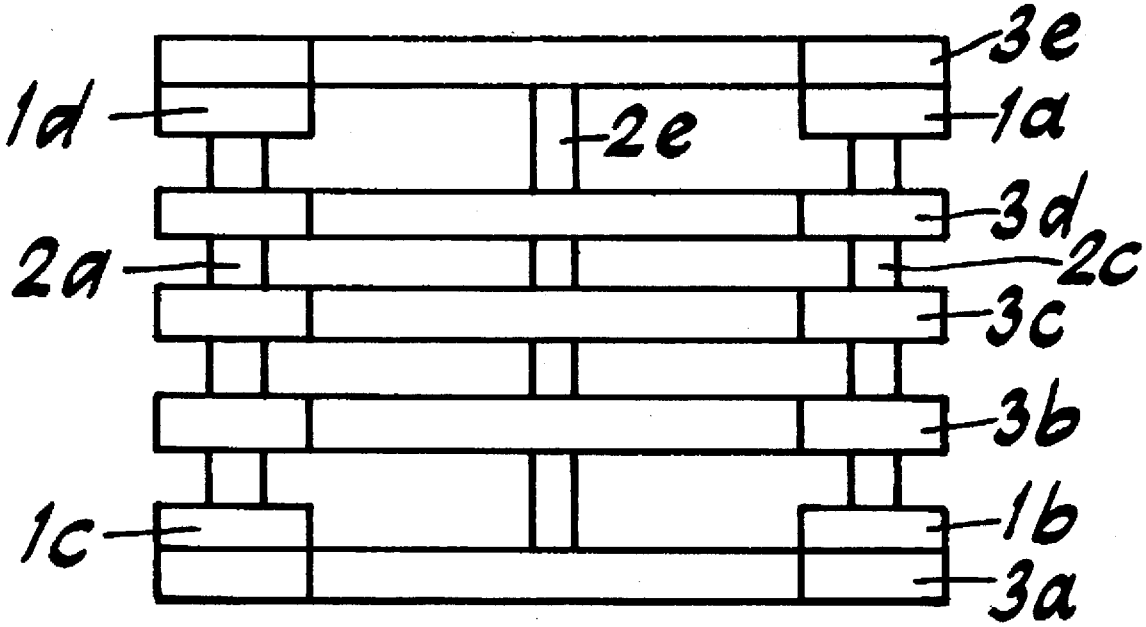

FIG. Ib shows a top view;

FIG. IIa shows a top view of charging rack whose frame comprises a nickel-based alloy and whose supporting parts comprise $Al_2O_3$;

FIG. IIb shows a lateral view;

FIG. IIc shows the section A—A from FIG. IIa; and

FIG. IId the section B—B from FIG. IIa.

DETAILED DESCRIPTION OF THE INVENTION

The charging rack shown in FIGS. Ia and Ib comprises a frame formed by the frame parts (1*a*) to (1*d*) and (2*a*) to (2*e*). The frame parts (1*a*) to (1*d*) have a rectangular shape and are fitted with two bores disposed one on top of the other, with the frame parts (2*a*) to (2*d*) extending through said bores. The frame parts (2*a*) to (2*d*) have a circular cross section. The charging rack has the five supporting parts (3*a*) to (3*e*), which are shaped in the form of U-profiles. The legs of each U-shaped profile have two bores disposed one on top of the other, in which the frame parts (2*a*) to (2*d*) are mounted. Each U-profile has a bore in the center of its base, through which the frame part (2*e*) extends.

The charging rack shown in FIGS. Ia and Ib has the shape of a grid. All parts of the charging rack comprise a dispersion-hardened iron-based alloy containing 19% Cr, 5.5% Al, 0.5% Ti, 0.5% $Y_2O_3$, the balance being iron. The individual parts of the charging rack are manufactured by the powder-metallurgical method by mechanically alloying the components of the alloy, subsequent hot compressing of the alloy, and subsequent reshaping. Mechanical alloying is carried out in a protective gas atmosphere comprising hydrogen, which enhances the weldability of the individual parts of the charging rack. All parts of the charging rack are joined with each other by welding. The charging rack has a weight of 2 kg and is capable of receiving shaped ceramic parts with a total weight of 4 kg. Owing to the very good thermoshock stability of the dispersion-hardened material used for the manufacture of the charging rack, the baking time for the shaped ceramic parts is reduced by 4.5 hours (from the cold to the cold state). A baking time of 20 hours is required in connection with a known charging rack made of ceramic material. Even after operating times in excess of 1000 hours, the charging rack according to the invention does not show any damage caused by corrosion even though the furnace atmosphere has increased contents of sulphur and fluorine compounds in the course of the baking process. The charging rack is suitable for baking operations carried out at 1100° to 1400° C. It is possible to equip the charging rack shown in FIGS. Ia and Ib with more than five supporting parts. Furthermore, the U-profile design of the supporting parts permits stacking of several charging racks one on top of the other.

The charging rack illustrated in FIGS. IIa–IId comprises a frame formed by the frame parts (4*a*) to (4*d*), as well as (5*a*) and (5*b*). The frame parts (4*a*) to (4*d*) have a rectangular shape and each have a recess, in which the frame parts (5*a*) and (5*b*) are mounted, the latter having a circular cross section. The frame parts comprise a dispersion-hardened nickel-based alloy containing 20% Cr, 0.3% Al, 0.5% Ti, 0.6% $Y_2O_3$, the balance nickel, said alloy being produced powder-metallurgically, using hydrogen as protective gas. All frame parts are joined with each other by welding.

The supporting parts (6*a*, 6*b*, 6*c*) comprise $Al_2O_3$ and have the shape of a "T", whereby the horizontal surface is used as the surface receiving the ceramic shaped parts to be baked. The supporting parts (6*a*, 6*b*, 6*c*) are connected with the frame parts (5*a*) and (5*b*) by providing the rod-shaped frame parts (5*a*) and (5*b*) with grooves extending vertically across the half cross section of the rod-shaped frame parts (5*a*) and (5*b*). The vertical piece of the "T" is inserted in said grooves to an extent such that the horizontal piece of the "T" is in contact with the rod-shaped frame part. Said connection has an adequately high strength and assures the required operational safety. The charging rack shown in FIGS. IIa–IId can be advantageously used with baking temperatures of about 1000° C. It is possible to stack several of such charging racks one on top of the other.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

What is claimed:

1. A charging rack for receiving shaped bodies made of ceramic and glass-ceramic materials which are baked in a furnace, the charging rack having the shape of a grid and comprising: a frame assembled from a plurality of frame members; and a plurality of supporting parts operatively connected to the frame, and whereby the frame members and supporting parts are manufactured from heat-resistant materials, wherein the members of the frame are produced from a dispersion-hardened iron- or nickel-based alloy, and the supporting parts are produced from the group consisting of the same dispersion-hardened iron- or nickel-based alloy as the frame member, silicon carbide, an oxide-ceramic material, a superalloy, or steel.

2. The charging rack according to claim 1, wherein the dispersion-hardened iron-based alloy comprises 10 to 40% Cr, 2 to 10% Al, 0 to 5% Ti, 0 to 10% Mo, 0 to 5% W, 0.1 to 2% $Al_2O_3$, $ZrO_2$, $La_2O_3$ and/or $Y_2O_3$, the balance Fe.

3. The charging rack according to claim 1, wherein the dispersion-hardened nickel-based alloy comprises 10 to 40% Cr, 0.1 to 4% Al, 0 to 10% Mo, 0 to 5% W, 0 to 5% Ti, 0.1 to 2% $Al_2O_3$, $ZrO_2$, $La_2O_3$ and/or $Y_2O_3$, the balance Ni.

4. The charging rack according to any one of claims 1 to 3, wherein the members and supporting parts comprising the dispersion-hardened alloys are joined to each other by one or more welds.

5. The charging rack according to claim 4, further comprising connecting means for connecting the supporting parts to the frame.

6. The charging rack according to claim 5, wherein the connecting means detachably connect the supporting parts to the frame.

7. The charging rack according to any one of claims 1 to 3, further comprising connecting means for connecting the supporting parts to the frame.

8. The charging rack according to claim 7, wherein the connecting means detachably connect the supporting parts to the frame.

* * * * *

UNITED STATES PATENT AND TRADEMARK OFFICE

CERTIFICATE OF CORRECTION

PATENT NO. : 5,667,379

DATED : September 16, 1997

INVENTOR(S) : Sporer

It is certified that an error appeared in the above-identified patent and that said Letters Patent is hereby corrected as shown below:

In the title appearing in col. 1, ln. 2, after "CERAMIC", please change "OF" to --OR--.

Signed and Sealed this

Twenty-fifth Day of November, 1997

*Attest:*

Bruce Lehman

BRUCE LEHMAN

*Attesting Officer*

*Commissioner of Patents and Trademarks*